US008256698B2

(12) United States Patent
Holmes

(10) Patent No.: US 8,256,698 B2
(45) Date of Patent: Sep. 4, 2012

(54) JAW ASSEMBLY FOR A JAW CRUSHER

(75) Inventor: Brett Gregory Holmes, Boya (AU)

(73) Assignee: Crushing & Mining Equipment Pty., Ltd., Naval Base, Western (AU)

( * ) Notice: Subject to any disclaimer, the term of this patent is extended or adjusted under 35 U.S.C. 154(b) by 456 days.

(21) Appl. No.: 12/445,382

(22) PCT Filed: Mar. 23, 2007

(86) PCT No.: PCT/AU2007/000372

§ 371 (c)(1),
(2), (4) Date: Oct. 30, 2009

(87) PCT Pub. No.: WO2008/046127

PCT Pub. Date: Apr. 24, 2008

(65) Prior Publication Data

US 2010/0044486 A1 Feb. 25, 2010

(30) Foreign Application Priority Data

Oct. 19, 2006 (AU) ..... 2006905802

(51) Int. Cl.
*B02C 1/10* (2006.01)

(52) U.S. Cl. ..... 241/207; 241/300

(58) Field of Classification Search ..... 241/207–216, 241/300

See application file for complete search history.

(56) References Cited

U.S. PATENT DOCUMENTS 2,758,794 A * 8/1956 Roubal ..... 241/291
3,153,512 A * 10/1964 Polzin ..... 241/300
5,857,630 A 1/1999 Hamaguchi et al.
6,957,786 B2 * 10/2005 Bratton et al. ..... 241/267

FOREIGN PATENT DOCUMENTS

GB 2387342 A 10/2003

OTHER PUBLICATIONS

Coulson and Richardson, Chemical Engineering vol. 2, 2nd Edition, See p. 651 figures 16.7 and 16.8.

* cited by examiner

*Primary Examiner* — Mark Rosenbaum
(74) *Attorney, Agent, or Firm* — Myers Bigel Sibley & Sajovec, P.A.

(57) ABSTRACT

A jaw assembly for a jaw crusher is disclosed where the assembly comprises a jaw stock (12), a wear plate (16), and a fastening device in the form of a bolt (34) with a square head (42) at one end and a washer (56) and fastening nut (52) positioned at an end opposite to the one end. The bolt (34) extends between the jaw stock (12) and the wear plate (16). The fastening device (34, 42, 56, 52) is operative to adopt a clamped configuration where the device provides a clamping force along a fastening axis to clamp the wear plate (16) at the jaw stock (12), and a released configuration where the fastening device does not prevent the wear plate (16) from being separated from the jaw stock (12). The fastening device (34, 42, 56, 52) is accessible from a direction that is transverse to that fastening axis, to enable the device (34, 42, 56, 52) to be changed from its clamped configuration to its released configuration.

23 Claims, 11 Drawing Sheets

JAW ASSEMBLY FOR A JAW CRUSHER

CROSS REFERENCE TO RELATED APPLICATIONS

This application is a 35 U.S.C. §371 national stage application of PCT Application No. PCT/AU2007/000372, filed on Mar. 23, 2007, which claims priority from Australian Patent Application No. 2006905802, filed on Oct. 19, 2006, the disclosure and content of each of which are incorporated by reference herein in their entireties. The above-referenced PCT International Application was published in the English language as International Publication No. WO 2008/046127 A1 on Apr. 24, 2008.

FIELD OF THE INVENTION

The present invention relates to components of a jaw crusher, which is an apparatus used for breaking feed materials that are passed thereinto. In one form the invention relates to a jaw assembly for a jaw crusher and will primarily be described with reference to this context.

BACKGROUND ART

Jaw crushers for breakage of materials are known in the art. Such apparatus includes two opposing supporting members known as jaw stocks, which are generally angularly disposed relative to each other, and which can be moved relative to one another by the motion of at least one of the jaw stocks. In normal circumstances the jaw stocks are generally plate-like and are arranged so as to define a tapering channel region therebetween. Also, the opposing faces of each jaw stock are generally fitted with a removable wear plate made of a hard, wear resistant material which is clamped thereto, to prevent abrasive damage to the jaw stocks during use of the crusher. These jaw stock faces which are fitted with the wear plates are known as the 'front inner faces'.

When preparing a jaw crusher for use, in some cases a wear plate is lowered into position on a sloping jaw stock surface and is initially retained in this position (to avoid dislodgement) by various flanges or shoulders that are either formed with, or welded or otherwise fastened to the said opposing front inner faces of the jaw stock pair. In some cases the wear plates have been cast with complementary recesses or slots to enable such retention to occur. At this point bolts or screws can then be inserted via the jaw stocks to clamp the wear plates in position. However, if the clamping fasteners or the supporting flanges or shoulders are damaged or become worn due to exposure from the flow of material across the wear plate, the wear plate can break free and become dislodged.

In use, relatively coarse feed materials such as rock, gravel, mineral ores and the like are passed under the influence of gravity into the channel formed between the wear plate/jaw stock pair and the motion of the or each jaw stock causes the feed materials to become crushed therebetween. The materials are thus comminuted or crushed to the point where they of a particle size small enough to pass through the distance between the wear plate/jaw stock pair, and consequently these materials then fall out of the base of the tapering channel region.

The surface of the wear plates are subjected to significant and uneven wear from the impact and sliding movement of feed material. Such wear plates can be made of an impact and wear resistant material such as manganese steel, whereas the jaw stocks are typically made of a relatively lower impact and wear resistant metal, which can more easily become damaged. It is impractical from both a cost, duty and repair perspective to manufacture the jaw stocks from the same impact and wear resistant material as the wear plates are made from.

After a period of time the wear plates become sufficiently worn due to impact and abrasion to require replacement. Since each wear plate is clamped to a respective jaw stock by various bolts or other types of fasteners located through the jaw stock itself, replacement maintenance requires that the crusher operation be stopped and the respective wear plates unscrewed or unbolted from the jaw stocks. Normally this is done by accessing the back outer face, of each jaw stock, i.e. via those sides of the jaw stocks that do not face toward the tapering channel region. This then allows removal of the worn wear plate from the front inner face of the jaw stock.

In the case of a movable or reciprocating jaw stock, the back outer face access can be obstructed by the crusher drive mechanism (or other mechanism or assembly) which may be required to cause the reciprocation of this jaw. It is also frequently the case that the fixed jaw stock is positioned immediately adjacent to major obstructions in the region of its back outer face, for example other pieces of equipment such as feeders (for introducing feed material into the crusher), walls, and so on. This can mean that the removal of the wear plates necessitates first moving surrounding steelwork and accessory items such as feed or drive mechanisms, chutes etc, or moving the whole jaw crusher from its in use position.

Alternatively, even if access to the fastening means can achieved with difficulty in confined and awkward spaces within which there are moving components etc, then this practice materially increases the hazards associated with such repair work. An example of where restrictions in space can cause such obstruction to the back of the fixed jaw stock include where a jaw crusher is positioned as part of a transportable and mobile crawler crusher unit within which the components of the total crusher assembly are tightly placed to achieve the smallest possible overall dimensions for the machine.

Frequent replacement of these wear components first involves stopping the jaw crusher and manually removing the various parts. This can be a complicated, awkward and difficult procedure especially with regard to the fixed jaw stock for the reasons already mentioned, leading to significant down time of the crusher. A high frequency of maintenance shutdown can be very costly from an operational standpoint.

SUMMARY OF THE INVENTION

In a first aspect the present invention provides a jaw assembly for a jaw crusher, the assembly comprising: a jaw stock, a wear component, and a fastening device extending between the jaw stock and the wear component, the device being operative to adopt a clamped configuration where the device provides a clamping force along a fastening axis to clamp the wear component at the jaw stock, and a released configuration where the fastening device does not prevent the wear component from being separated from the jaw stock, wherein the fastening device is accessible from a direction transverse to the fastening axis to enable the device to be changed from its clamped configuration to its released configuration.

By arranging the fastening device to be accessible from a direction transverse to the fastening axis, an operator can have unobstructed access to the back face of a fixed or a movable jaw stock regardless of whether such a jaw stock is arranged immediately adjacent to any obstructions at or near the back face. Such ease of access can simplify the maintenance replacement of wear components by reducing the complexity and awkwardness of the task and the need to remove entire components or the jaw crusher itself. This may also lead to improvements in occupational safety, such as reducing the risks involved in accessing the fastening means or manoeuvring or moving heavy items of equipment.

Throughout this specification, when the term "jaw stock" is used it can include those arrangements where the wear component is fastened directly to a unitary jaw stock item, as well as arrangements in which the jaw stock itself comprises two or more pieces (and to which the wear component is also fitted or in direct or indirect contact therewith). In an arrangement of the latter, the jaw stock can comprise both a base casting and a so-called "backing plate" positioned between the base casting and the wear component in use. A "backing plate" is a sacrificial plate used to assist in the protection of the major components from damage. This is normally a simple piece of mild steel plate, typically profiled from about 10-20 mm or other suitable thickness metal (such as steel). It can be fastened to the jaw stock by plug welding, but may also be fastened thereto with threaded fasteners or dowels. In the art, such a backing plate is also known as a protection plate, heel plate or a sole plate. In still further arrangements, some jaw crushers can have a jaw stock which comprises said base casting and an "intermediate plate", which is a much thicker item than the backing plate referred to earlier but is located in a similar position. The intermediate plate is designed to build up the profile of the jaw stock so as to change the nip angle and/or nominal closed side setting gap between the wear plates on opposing jaws of the crusher, for example by being wedge-shaped in profile from top to bottom. If present, this piece can also have a backing plate installed onto it to protect it.

In one embodiment the fastening device can be accessible from a direction transverse to the fastening axis to enable the device to be changed from its released configuration to its clamped configuration.

In one embodiment, the assembly incorporates a cavity that extends from said fastening device to allow the transverse access to said device. The cavity can be arranged at the sides of the assembly. In one embodiment, the fastening device when in the released configuration can be removable via the cavity, although in other arrangements the fastener itself need not be removed at all but can remain generally in position whilst the wear component is separated from the jaw stock for replacement.

In one embodiment, the cavity can be adapted to be fully or partially enclosed by a detachable member. In one form of this, the side access to the cavity can be blocked by a member in the form of a plate which can be detachably fastened to the sides of the assembly.

In one embodiment, the jaw stock can be arranged with a front face against which the wear component is clamped and two sides depending from the front face, the cavity arranged at the or each side of the jaw stock.

In one form of this, the wear component can be a wear plate arranged with a rear face and a working face spaced apart by two side edges, the rear face arranged to be located in a close facing arrangement with the front face of the jaw stock when in the clamped configuration. Other shapes of wear component are possible depending on the configuration of the jaw crusher.

In one embodiment, the fastening device can comprise a bolt with a head that is arranged to bear against a surface of the wear component when in the clamped configuration, so as to bias the wear component into a desired position.

In one form of this, the fastening device may also comprise a nut arranged to be located at an end region of the bolt which is opposite the head, the nut being arranged to bear against a part of the cavity of the jaw stock when in the clamped configuration. In alternative arrangements, the fastening device may use tightening arrangements other than a nut, for example a ratchet.

In one embodiment, the head of the bolt can be received in a recess which is located at the rear face of the wear component. In one form, the said wear component recess also extends from the bolt to allow the bolt to be moved in a direction transverse to the fastening axis of the bolt. In one arrangement of this, the bolt when in the released configuration is removable via said wear component recess. In other forms, the recess may be discrete and positioned at the wear face of the wear component some distance from the edges thereof so that the bolt is not removable and does not leave the general vicinity of the recess, whilst still allowing the wear component to be released.

In one embodiment, said wear component recess is concealed from view at the working face so that when the bolt is received in the wear component recess it is not visible from an interior of the jaw crusher. Concealment of the bolt from the material fed into the jaw crusher in use prevents exposure to abrasive wear or breakage of the bolt and thus reduces the risk of the wear plate becoming dislodged in use. This in turn reduces the down time of the jaw crusher and attendant losses in operating revenue.

In an alternative embodiment, the head of the bolt may be arranged to bear against an uppermost in use edge of the wear component, and not into a wear component recess at all. In one form of this, the said uppermost in use edge of the wear component can be arranged to allow the bolt to be moved in a direction transverse to the fastening axis of the bolt, for example by having a flat uppermost edge which does not obstruct transverse directional movement.

In an alternative embodiment, the fastening device may comprise a bolt with a head and an elongate bar, wherein the head of the bolt is arranged to bear against the elongate bar which is itself positioned to bear against an uppermost in use edge of the wear component when in the clamped configuration.

In one form of this, the head of the bolt can be arranged to be positioned in a recess located in the elongate bar. In one form said recess also extends from the bolt to allow the bolt to be moved in a direction transverse to the fastening axis of the bolt. In an alternative arrangement, the bolt can be arranged to be positioned at the elongate bar by threading engagement with the bar.

In another embodiment, the said wear component recess may define a slot into which the bolt can be moved in a direction transverse to the fastening axis of the bolt and in which the bolt is located in the clamped configuration.

In an embodiment, the wear component can be made of an impact and wear resistant material, such as a manganese steel, or a toughened, tempered or hardened metal alloy, or a steel product which has been subjected to a toughening, tempering or hardening process, or a combination thereof.

In an embodiment, the fastening device and the wear component may be defined by an arrangement of interfitting projections and recesses which permit fastening and release of the wear plate from the jaw stock. For example, the fastening device may be an elongate pin and the cavity a correspondingly-shaped hole for receipt thereof. In an alternative form, the fastening device may be a plate-like tongue and the cavity a correspondingly-shaped slot for receipt thereof. In either of these forms, the fastening device may be located in position by threading engagement with, or by a coupler which is located in, the cavity of the jaw stock. Such a coupler can include one of a pin, a screw, an R-clip or the like, receivable in a hole in the fastening device and fastenable in use to a portion of the cavity of the jaw stock.

In an embodiment, the fastening axis can be arranged substantially orthogonally to the jaw stock and to the wear component, although in other embodiments the fastening axis can be arranged at any angle away from orthogonal provided that release of the wear component from the jaw stock can be accomplished.

In an embodiment, the jaw stock can comprise two or more pieces. In one form of this, the jaw stock can comprise a base member and one or both of a backing plate and an intermediate plate fitted thereto disposed in use to be located between the base member and the wear component.

In a second aspect the present invention provides a method of operating a fastening device used to clamp a jaw stock and a wear component where the fastening device has a fastening axis, the method comprising the steps of:

(a) accessing the fastening device from a direction transverse to the fastening axis;

(b) releasing the fastening device so that the wear component and the jaw stock are separable.

In one embodiment, the method can further comprise the step of operating the fastening device so that the wear component and the jaw stock are in a clamped configuration.

In one embodiment of the method, the jaw stock, the wear component and the fastening device used are otherwise as defined in the first aspect.

In a third aspect, the present invention provides a jaw crusher including the jaw assembly as defined in the first aspect.

In a fourth aspect, the present invention provides a jaw stock suitable for use as part of the jaw assembly as defined in the first aspect.

In a fifth aspect, the present invention provides a wear component suitable for use as part of the jaw assembly as defined in the first aspect.

BRIEF DESCRIPTION OF THE DRAWINGS

Notwithstanding any other forms which may fall within the scope of the present invention, preferred forms of the invention will now be described, by way of example only, with reference to the accompanying drawings in which:

FIG. 11 shows the front face of the moveable jaw stock and one exemplary rectangular-headed bolt and nut for clamping the wear plate to the jaw stock. FIG. 11A shows the rear face of a wear plate arranged with recesses suitable for receiving the rectangular-headed bolt.

FIG. 11B shows the rear face of the moveable jaw stock having holes for receiving exemplary rectangular-headed bolts for clamping the wear plate to the jaw stock with a nut. FIG. 11C shows the rear face of a wear plate arranged with recesses that are each suitable for receiving a rectangular-headed bolt.

MODES FOR CARRYING OUT THE INVENTION

Figure 1:
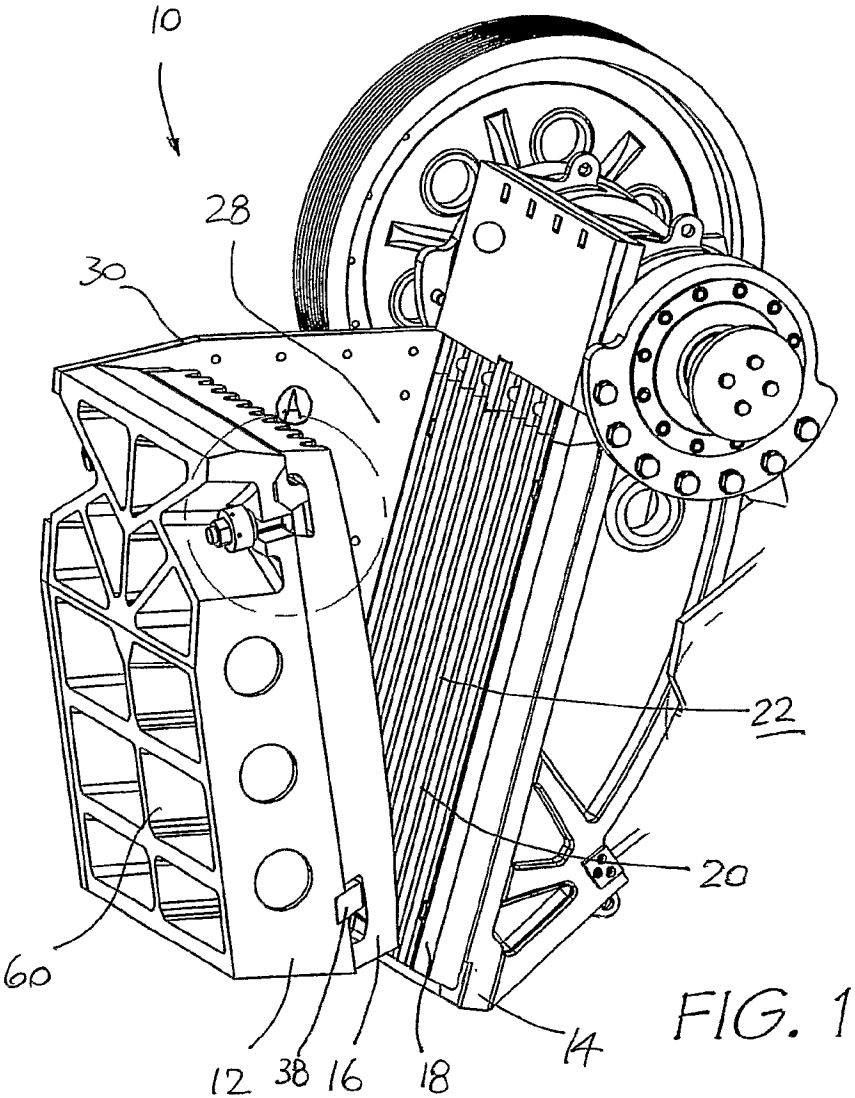
FIG. 1 shows a partial perspective view of an embodiment of a jaw crusher having a jaw assembly located at a fixed jaw stock, in accordance with the present invention.

Referring to FIGS. 1, 1A, 1B, 1C, 1D, 2 and 3, a portion of a jaw crusher 10 is shown having a fixed jaw stock 12 and a movable jaw stock 14. Each jaw stock 12, 14 is fitted with a respective wear component in the form of a wear plate 16, 18 made of a wear resistant material such as manganese steel, or a hardened metal alloy, or a hardened steel product which has been subjected to a hardening process. As shown in the drawings, the wear plates 16, 18 are arranged with a series of elongate, downwardly extending surface ribs 20 defining a working face 22 thereof. The wear plate 16 of the fixed jaw 12 has a rear face 24 which is arranged to be located in a close-facing arrangement with a front inner face 26 of the jaw stock 12 when mounted thereto in a clamped configuration. Similarly, although the detail is not shown in these drawings, the wear plate 18 of the movable jaw stock 14 has a rear face which is arranged to be located in a close-facing arrangement with a front inner face of the jaw stock 14 when mounted thereto in a clamped configuration.

Figure 3:
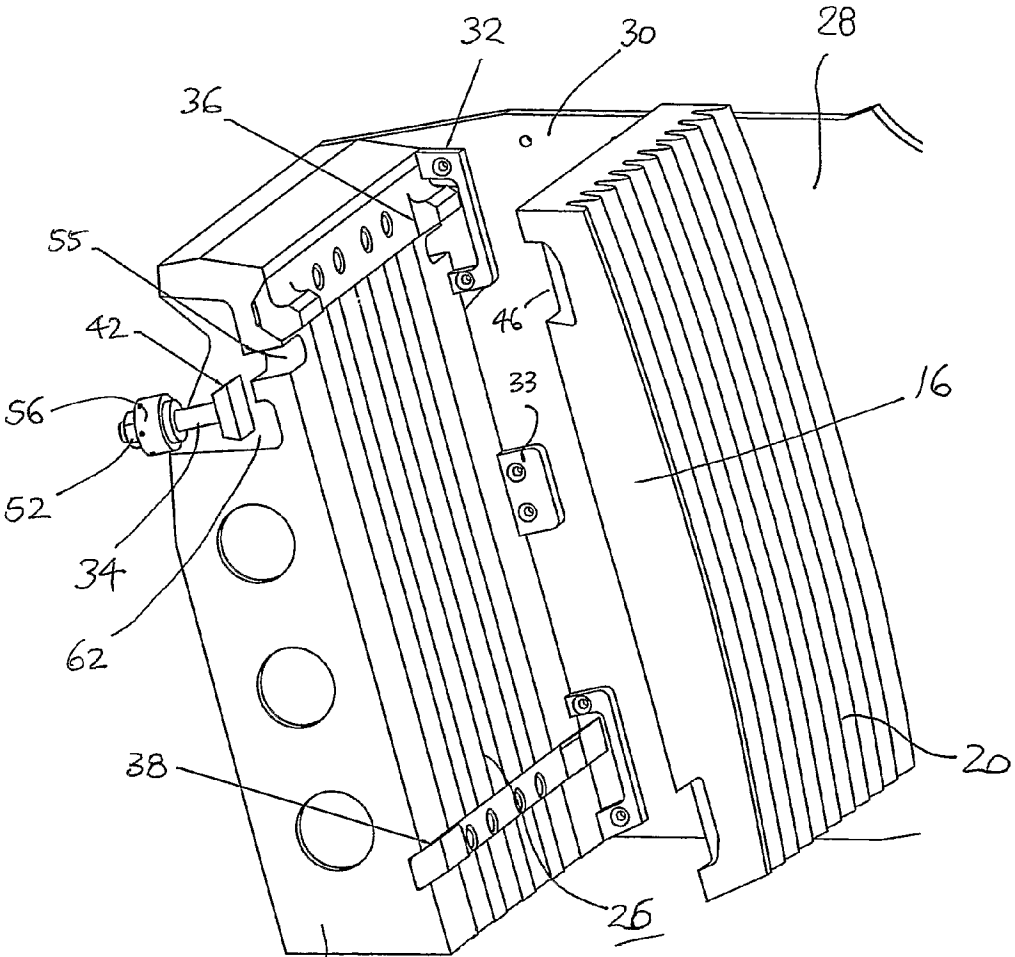
FIG. 3 shows a perspective, exploded view of the embodiment of the jaw assembly of FIGS. 1 and 2. In particular this Figure shows the released configuration of the jaw assembly with the wear plate spaced apart from the jaw stock, and also spaced apart from the square-headed bolt and a nut used to clamp them together.
Figure 2:
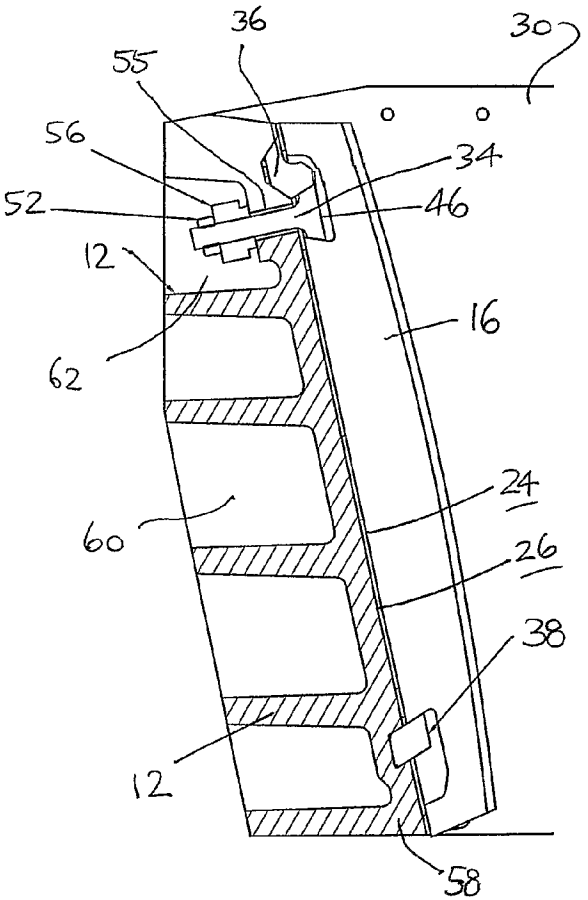
FIG. 2 shows a part-sectional side view of the embodiment of the jaw assembly of FIG. 1. In particular this Figure shows a wear plate clamped to a fixed jaw stock by a square-headed bolt and a nut. In this drawing the jaw stock itself is shown in a cross-sectioned view to show details of a generally honeycomb-like stiffening structure which depends outwardly from the back of the fixed jaw stock. The other components (wear plate, bolt, nut, etc) are not shown sectioned.

The two jaw stocks 12, 14 and their respective wear plates 16, 18 are angularly disposed relative to each other so as to define a tapering channel region 28 located therebetween. The interior tapering region 28 is also defined by two side walls 30, 31 of the jaw crusher which retain material being crushed between the two jaws. Only one such side wall 30 is shown in FIG. 1 and FIG. 3, and both side walls 30, 31 are shown in FIGS. 1B, 1C and 1D. These side walls 30, 31 may be suitably mounted to the fixed jaw 12 by side brackets 32, 33, for example, although other mounting arrangements are possible. Typically, feed materials for breakage are gravity-fed into the interior tapering region 28 of the jaw crusher 10. Typical feed materials can include rock, gravel, mineral ores, metalliferous slags, glass and the like.

Having regard to the fixed jaw 12, a fastening device in the form of an elongate, square-headed bolt 34 is shown extending between the jaw stock 12 and the wear plate 16. The bolt 34 can be operated to adopt a clamped configuration in which a clamping force is provided along the axis of the bolt 34. As shown by FIGS. 1, 1A, 2 and 3, the installation of the wear plate 16 involves lowering it into position at the jaw stock 12 so as to rest on a lower seat strip or bar 38 which is itself welded, bolted riveted or otherwise seated at the front inner face 26 of the fixed jaw stock casting 12. Similarly an upper seat strip or bar 36 is fitted at the front inner face 26 of the fixed jaw stock casting 12 for use during the clamping function, as will now be described.

Figure 1A:
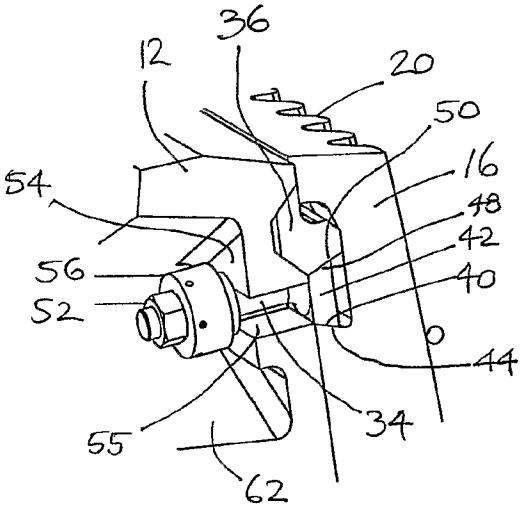
FIG. 1A shows a view of a detail of the portion the embodiment of FIG. 1 that is shown in the circle A of dotted outline, and in which a portion of the jaw assembly is shown.
Figure 1B:
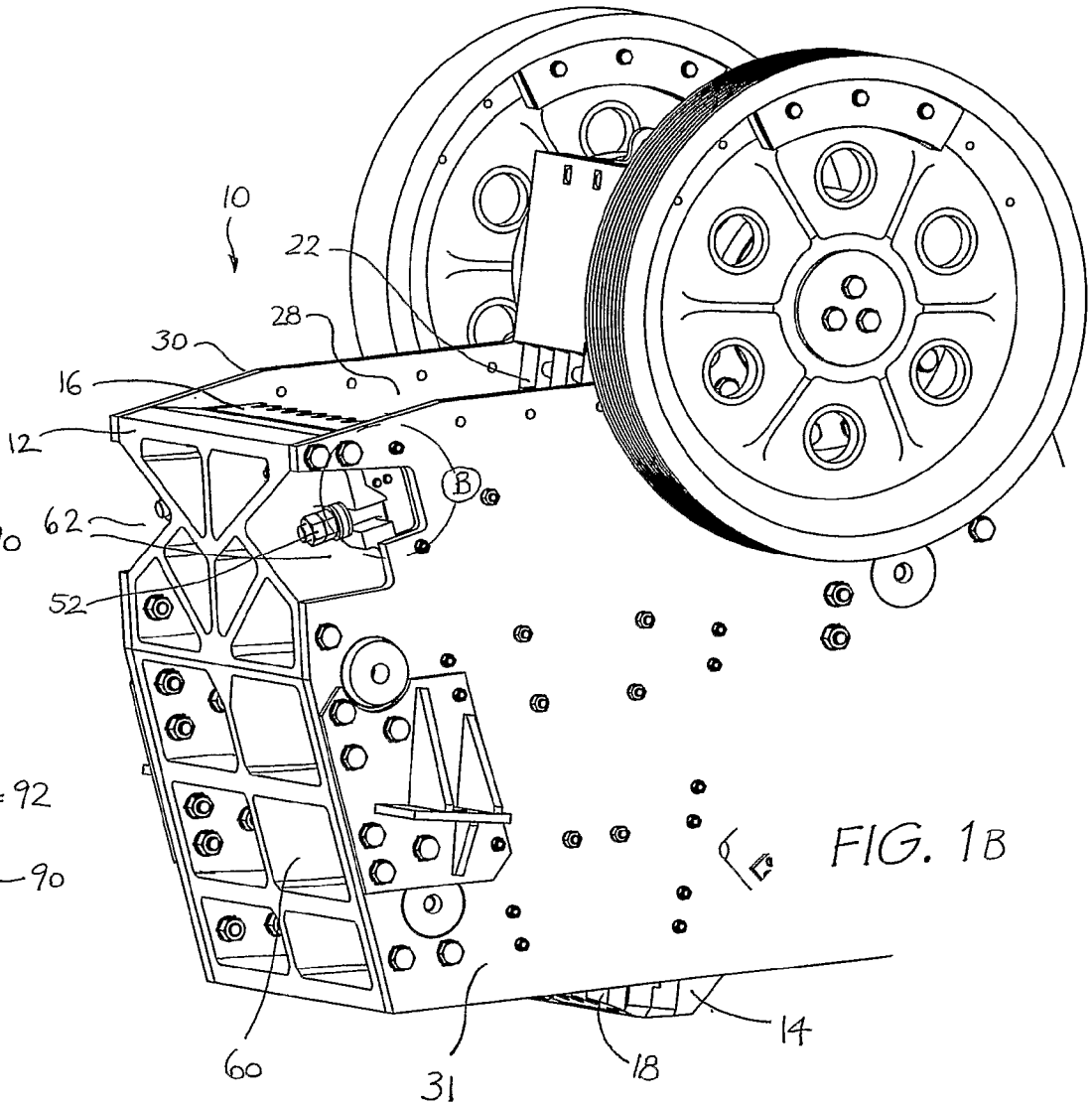
FIG. 1B shows a perspective view of the embodiment of the jaw crusher of FIG. 1, with two side walls shown enclosing a tapering channel region between crusher jaws.
Figure 1C:
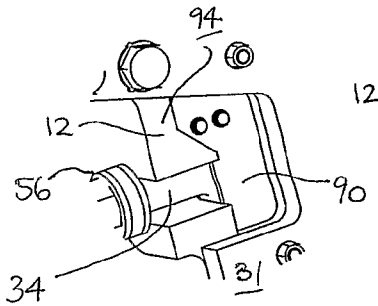
FIG. 1C shows a view of a detail of the portion of the embodiment of FIG. 1B that is shown in the circle B of dotted outline, and in which a portion of the jaw assembly is enclosed by a member in the form of a plate which is detachable from the jaw crusher side wall.
Figure 1D:
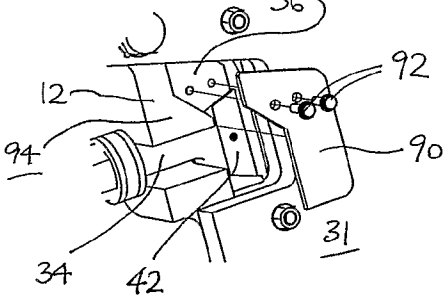
FIG. 1D shows a perspective, exploded view of the portion of FIG. 1C in which the plate is shown detached from the jaw crusher side wall.

As is best shown in FIG. 1A, to clamp the wear plate 16 to the desired position at the jaw stock 12, the lower bevelled side 40 of the bolt head 42 bears or presses against a complementary-shaped, side edge 44 of a recess 46 that is located in the rear face 24 of the wear plate 16. The upper bevelled side 48 of the bolt head 42 simultaneously presses against a complementary-shaped edge 50 on the upper seat strip 36. In use the bolt 34 can be retracted away from the wear plate 16 in an axial direction by rotation of a lock nut 52 which is located at the distal end of the bolt 34 away from the square head 42. This results in a biasing and clamping of the wear plate 16 against the jaw stock 12. The nut 52 is partially seated at the back wall 54 of the jaw stock 12 so as to tension the bolt 34 (with a hydraulic washer 56 also shown between the back wall 54 and the nut 52). In this arrangement the wear plate 16 is then mounted to the jaw stock 12 for operation of the jaw crusher 10.

Conversely, when the lock nut 52 is rotated so that the bolt 34 can be moved in an axial direction towards the wear plate 16, the wear plate 16 is then able to be moved into a released configuration where the bolt 34 and nut 52 do not prevent the wear plate 16 from being separated from the jaw stock 12. In such a configuration the bolt head 42 is moved sufficiently into the recess 46 formed in the rear face 24 of the wear plate 16 such that the wear plate 16 can be disengaged from the jaw stock 12 and lifted out of the tapering channel region 28 of the jaw crusher 10 without the bolt 34 itself needing to be removed from its general position at all. However as shown in FIG. 3, the bolt 34 and nut 52 can also be entirely removed from engagement with the jaw stock 12 and wear plate 16 by sliding the bolt 34 and nut 52 transversely from the clamping position and out of the aligned side wall cavities 55, 46 which are formed in side edge regions of both the jaw stock 12 and wear plate 16 respectively.

Access to the bolt 34 and nut 52 is effected from a direction that is transverse to the fastening axis (or the axis of the elongate bolt 34) to enable the jaw stock 12 and wear plate 16 pair to be changed from its clamped configuration to its released configuration. In this regard the fixed jaw stock casting 12 is generally arranged comprising a sheet 58 with a generally honeycomb-like stiffening structure 60 depending outwardly from the back outer face thereof. The uppermost side corners of the stiffening structure 60 each have a recess 62 located thereat, where the recess 62 is generally of a triangular prism shape. The distal end of the bolt 34, and the nut 52 (and washer 56) are positioned in the recess 62 and are readily accessible from each side of the jaw stock 12. An operator can reach a hand or a tool into the recess 62 and loosen the nut 52 and washer 56 to permit movement of the bolt 34 in an axial direction. Unlike conventional arrangements for retaining a wear plate at a jaw stock, in the back outer face access arrangement shown in FIGS. 1, 1A, 2 and 3 the access is completely unaffected by the presence of other parts of the jaw crusher or adjacent pieces of equipment. In the embodiment shown in the Figures, no part of the fastening device (34, 42, 52, 56) projects beyond a back edge of the jaw stock 12.

As shown in the FIGS. 1, 1A, 2 and 3, the bolt 34 itself is concealed from the interior 28 of the jaw crusher 10 when located in the wear component recess 46, so as to minimise abrasive wear. This reduces the incidence of wearing of the clamping fasteners (or the supporting flanges or shoulders) by materials that flow into the crusher during use. In some conventional crusher arrangements, exposed fasteners can quickly become worn and this can allow the wear plate can break free and become dislodged, creating safety hazards and operational difficulties.

In further embodiments, other shapes of bolt and bolt head can be used, as well as other means of tensioning the bolt. In further embodiment, there can be a plurality of such fasteners used to clamp a wear plate to a jaw stock.

Referring specifically now to FIGS. 1C and 1D, the recess 62 is partially enclosed at the side of the jaw crusher by a detachable plate 90 which is screwingly fastened at the fixed jaw stock 12 by two hexagonal-headed threaded screws 92. The screws 92 are arranged to pass through holes in the plate 90 and to be threadingly received in the end of the upper seat strip 36. In the embodiment shown, these screws 92 are oriented orthogonally to the plate 90 and to the side edge surface 94 of the fixed jaw stock 12. Undoing the screws 92 and then detaching the plate 90 then permits access to the bolt 34 and nut 52 from a direction that is transverse to the fastening axis (that is, the axis of the elongate bolt 34), to enable the jaw stock 12 and wear plate 16 pair to be changed from its clamped configuration to its released configuration.

The detachable plate 90 functions generally to reduce or exclude the ingress of dust, grit and the like from the region of the fastening device 34, 42, 52, 56 during crushing operations, so as to facilitate ease of movement of these components and allow clamping and release of the wear plate 16 from the jaw stock 12. For example, the ingress of such material into the cavity 55 or the recess 62 can sometimes make it difficult for an operator to easily turn the nut 42 and washer 56 so as to release the bolt 34. In addition, the plate can act to restrain any tendency for sideways movement of the bolt 34 and nut 42, should these components become loose during operation of the jaw crusher.

Referring now to FIGS. 4 to 10, in order to avoid repetition and for ease of reference, components and features of equivalent parts of the invention of similar functionality to those identified in FIGS. 1, 1A, 2 and 3 have, for different embodiments, now been designated with an additional "A", "B", "C" etc, such as the fixed jaw stock 12A.

Figure 4:
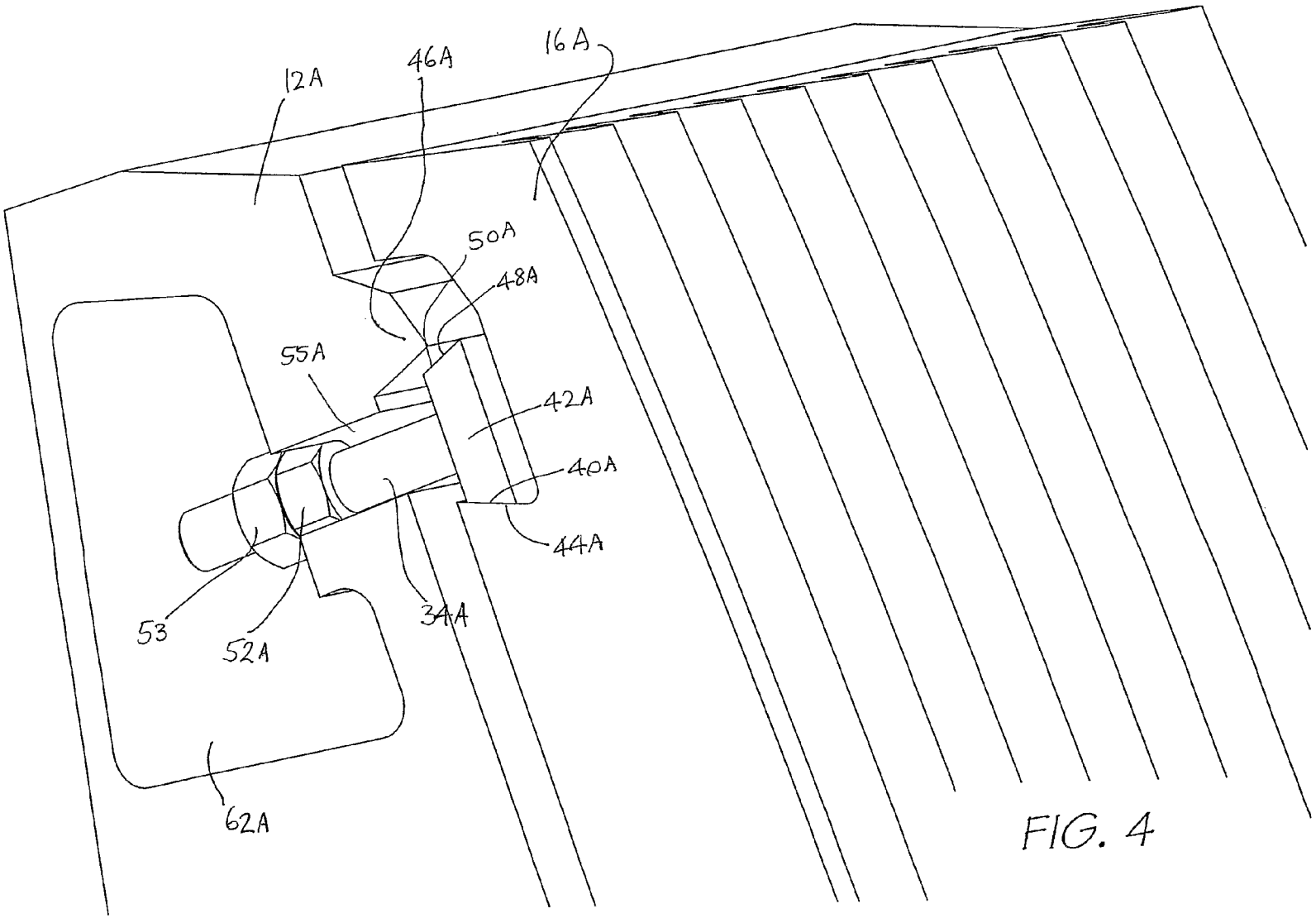
FIG. 4 shows a perspective view of part of an embodiment of a jaw assembly located at a fixed jaw stock, in accordance with the present invention. In particular this Figure shows a wear plate clamped to a jaw stock by a square-headed bolt and a nut.

The embodiment shown in FIG. 4 is in all respects similar to that already shown in previous figures, except that the square-headed bolt 34A is fastened at the fixed jaw stock 12A by two hexagonal nuts 52A, 53 tightened against one another, rather than a single nut and a sprung washer. In this embodiment there is no upper seat strip 36 located at the front face 26A of the jaw stock casting 12A, and the upper 48A and lower 40A bevelled edges of the square head 42A of the bolt 34A are respectively arranged to bear against a complementary-shaped ridge 50A on the jaw stock 12A itself and against a lower edge 44A of a recess 46A located in the back of the wear plate 16A.

Also in this embodiment, access to the bolt 34A and nuts 52A, 53 is effected from a direction that is transverse to the fastening axis via an uppermost side corner of the jaw stock at which is located an end opening of a recess in the form of an enclosed channel 62A. This channel 62A is of a generally rectangular cross-sectional shape, and is arranged to extend across the width of the jaw stock 12A. The bolt 34A and the nuts 52A, 53 are positioned at the outermost edges of the jaw stock 12A. The bolt 34A and nuts 52A, 53 can be entirely removed from engagement with the jaw stock 12A and wear plate 16A by sliding the bolt 34A and nuts 52A, 53 transversely from the clamping position and out of the aligned side wall cavities 55A, 46A which are formed in the jaw stock 12A and wear plate 16A respectively.

Figure 5:
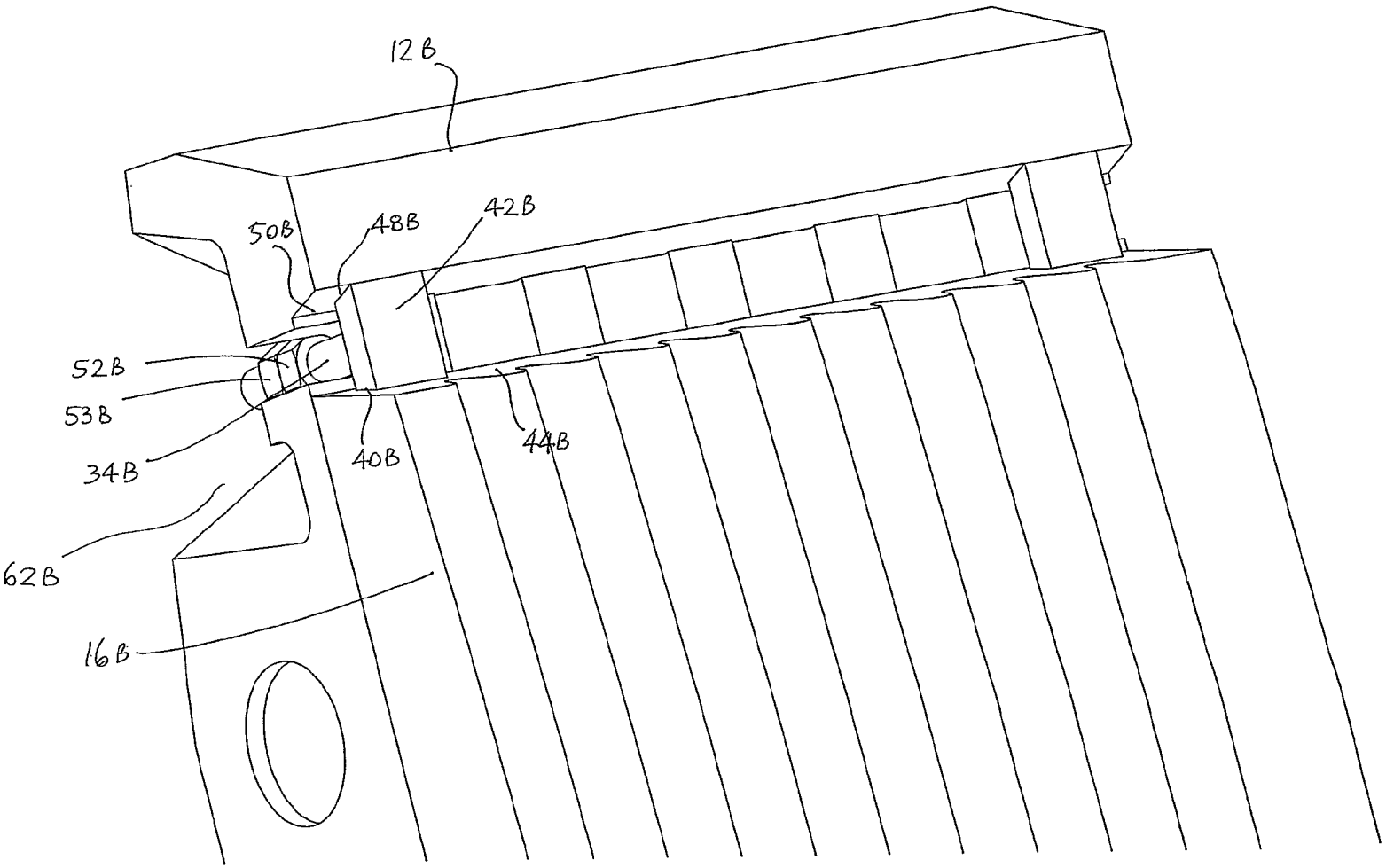
FIG. 5 shows a perspective view of part of an embodiment of a jaw assembly located at a fixed jaw stock, in accordance with the present invention. In particular this Figure shows a wear plate clamped to a jaw stock by a square-headed bolt and a nut.

The embodiment shown in FIG. 5 is in all respects similar to that already shown in FIG. 4, except that the upper 48B and lower 40B bevelled edges of the square head 42B of the bolt 34B are respectively arranged to bear against a complementary-shaped ridge 50B on the jaw stock 12B itself and against an upper edge 44B of the wear plate 16B itself. In this regard, the square-headed bolts 34B are visible from an interior 38B of the jaw crusher but are located above the wear plate 16B and hence the materials handling, zone. Also in this embodiment, access to the bolt 34B and nuts 52B, 53B (and removal thereof) is effected from a direction that is transverse to the fastening axis via an uppermost side corner of the jaw stock 12B at which is located a generally triangular prism-shaped corner recess 62B, of the same general type as shown in FIG. 1, for example.

Figure 7:
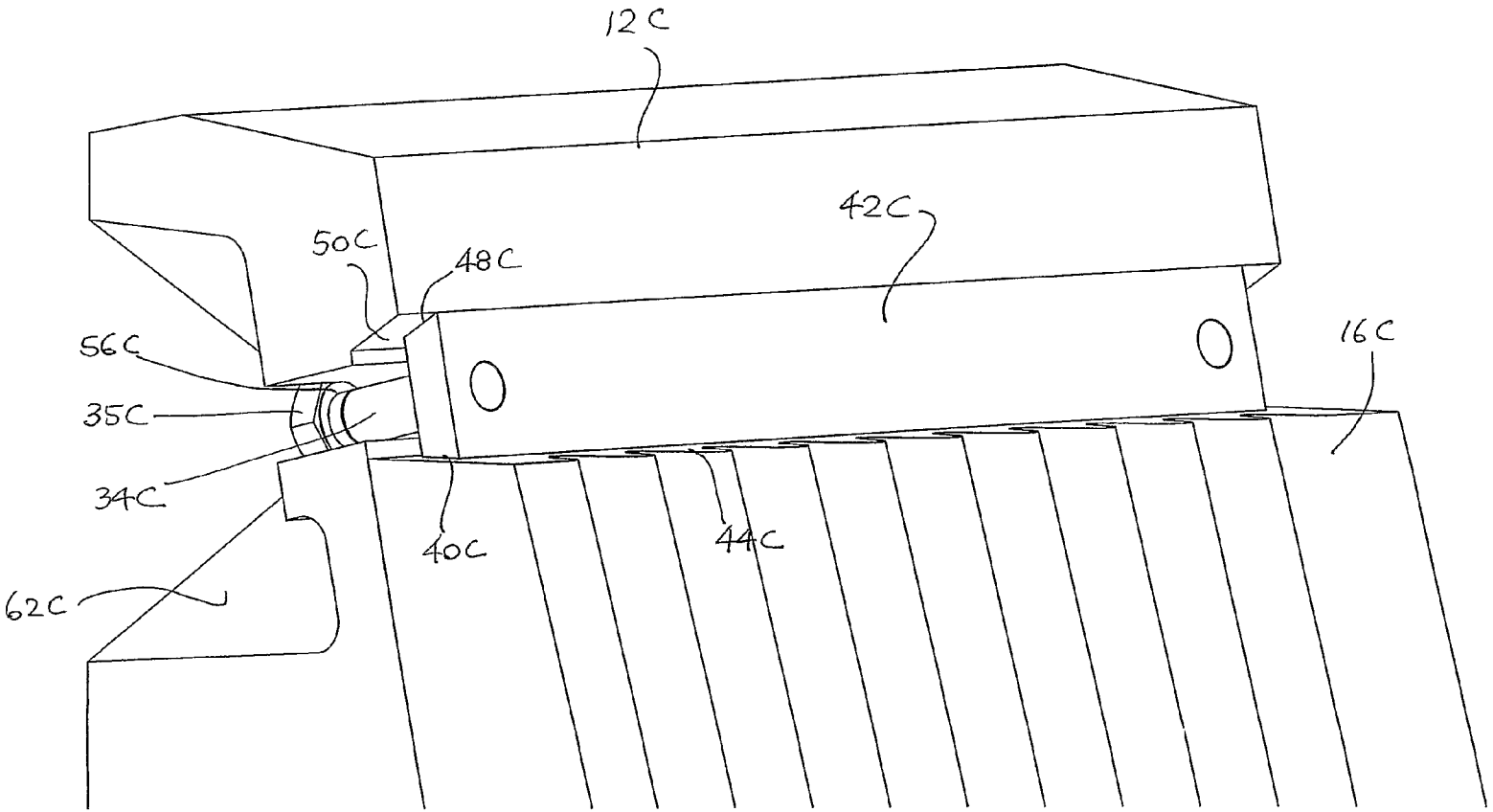
FIG. 7 shows a perspective view of part of an embodiment of a jaw assembly located at a fixed jaw stock, in accordance with the present invention. In particular this Figure shows a wear plate clamped to a jaw stock by a wedge which extends almost fully across the width of the jaw stock and the wear plate, and which is held in place by two hexagonal bolts threaded into the wedge.
Figure 8:
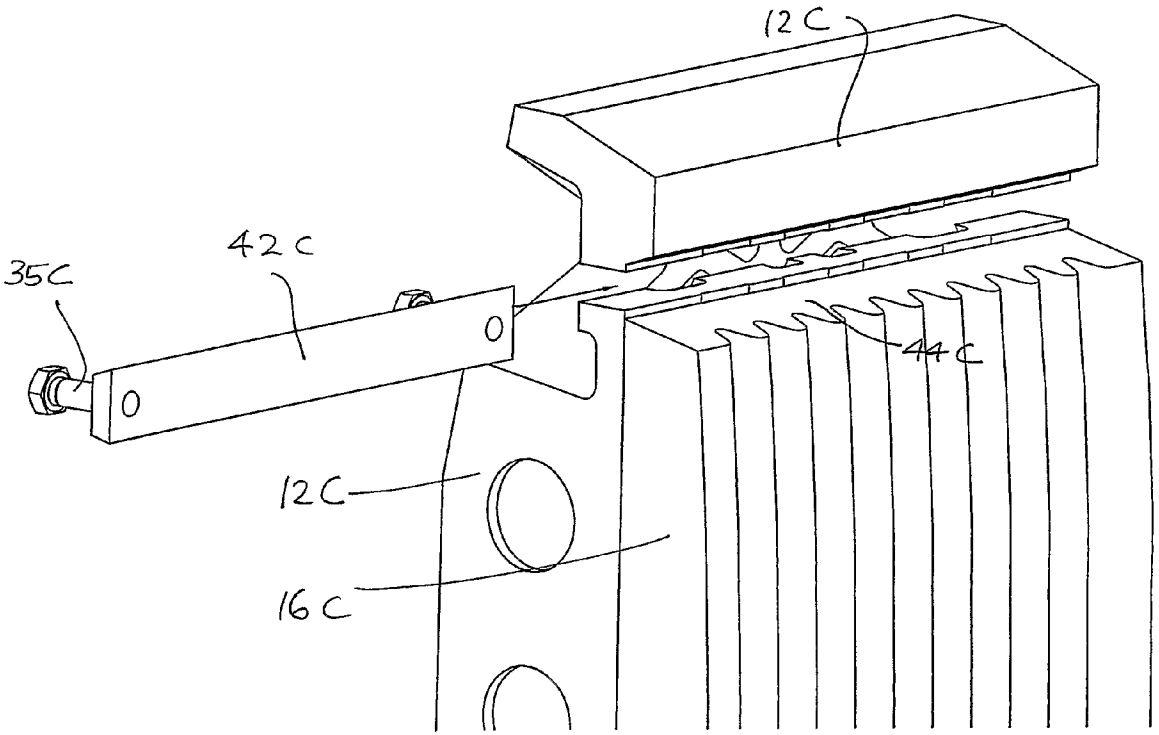
FIG. 8 shows a perspective, part-exploded view of the embodiment of the jaw assembly of FIG. 7. In particular this Figure shows the released configuration of the jaw assembly with the wedge unclamped from the jaw assembly.
Figure 9:
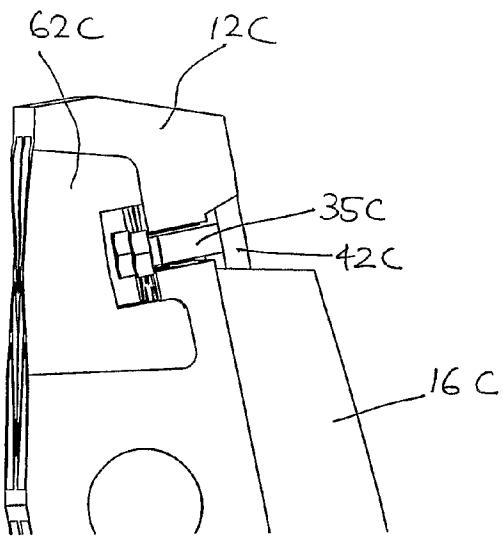
FIG. 9 shows a side view of the embodiment of the jaw assembly of FIG. 7.

The embodiment shown in FIGS. 7, 8 and 9 is in all respects similar to that already shown in FIG. 5, except that the wear plate 16C is clamped to the jaw stock 12C by an elongate, tapered wedge 42C rather than individual square-headed bolts. The wedge 42C extends almost fully across the width of the jaw stock 12C and the wear plate 16C (and in further embodiments can be arranged to extended all of the way across the width of the respective jaw stock and wear plate). The wedge 42C has an upper edge 48C and a lower edge 40C that are respectively arranged to bear against a complementary-shaped ridge 50C on the jaw stock 12C itself, and against an upper edge 44C of the wear plate 16C itself. In this regard the wedge 42C is visible from an interior 38C of the jaw crusher but is located above the wear plate 16C and hence the materials handling zone. The bolt 34C is positioned at the wedge 42C by threading engagement therewith. The head of the bolt 35C is located so as to be in contact with the back wall 54C of the jaw stock 12C so as to tension the bolt 35C (with a washer 56C also shown behind the back wall 54C), and positioned in the recess 62C which is of a general triangular prism shape. As shown in FIG. 8 the wedge 42C can be slidingly positioned between the jaw stock 12C and the upper edge 44C of the wear plate 16C, prior to the bolt 35C being tightened, and vice versa for achieving release of the wedge 42C and hence the wear plate 16C.

Figure 6:
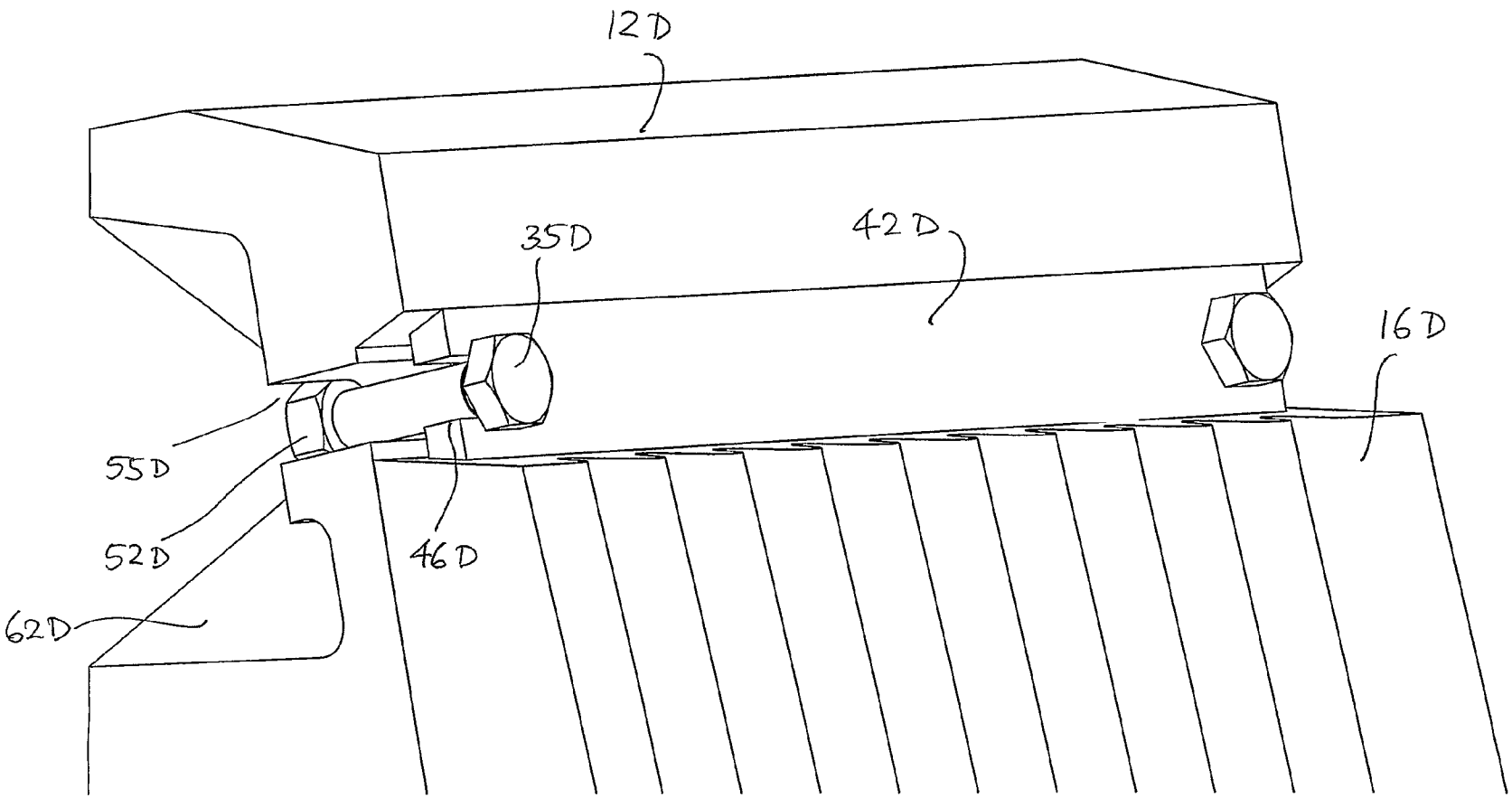
FIG. 6 shows a perspective view of part of an embodiment of a jaw assembly located at a fixed jaw stock, in accordance with the present invention. In particular this Figure shows a wear plate clamped to a jaw stock by a wedge which extends almost fully across the width of the jaw stock and the wear plate, and which is held in place by two hexagonal bolts and nuts.

The embodiment shown in FIG. 6 is in all respects similar to that already shown in FIGS. 7, 8 and 9, except that the elongate, tapered wedge 42D is positioned using hexagonal headed bolts 35D which are inserted into aligned cavities 55D, 46D in the sides of the jaw stock 12D and in the ends of the elongate wedge 42D with a corresponding hexagonal nut 52D in contact with the back wall 54D of the jaw stock 12D so as to tension the bolt 35D, and positioned in the recess 62D which is of a general triangular prism shape. As was the case for the embodiment shown in FIG. 8, the wedge 42D can be slidingly positioned between the jaw stock 12D and the upper edge of the wear plate 16D, prior to the nut 52D being tightened at the bolt 35D, and vice versa for achieving release of the wedge 42D and hence the wear plate 16D.

Figure 10:
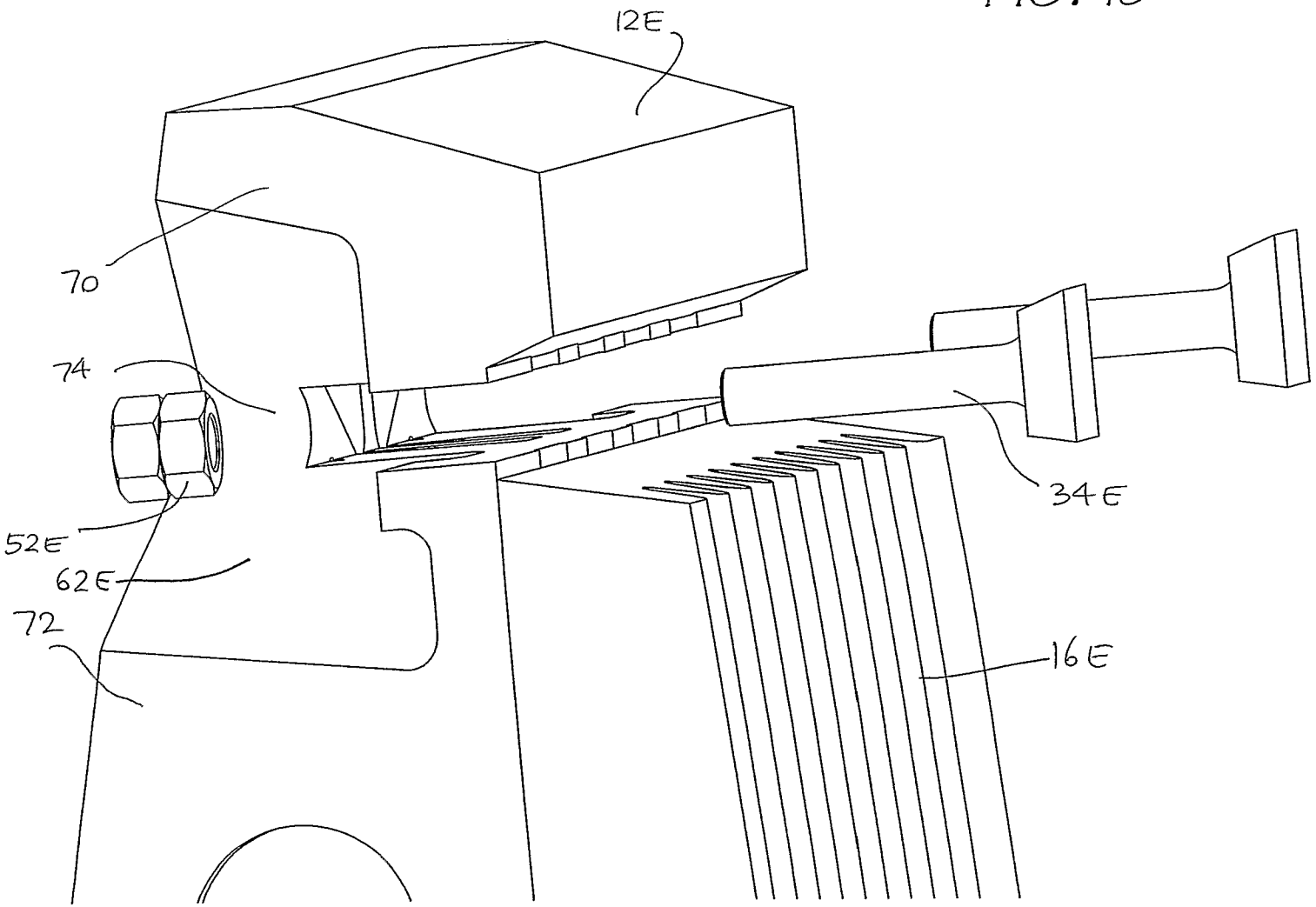
FIG. 10 shows a perspective, part-exploded view of an embodiment of a jaw assembly located at a fixed jaw stock, in accordance with the present invention. In particular this Figure shows a partly-released configuration of the jaw assembly with the wear plate located at the jaw stock, but the square-headed bolts and respective nuts used to clamp them together shown spaced apart from the remainder of the assembly.
Figure 11A:
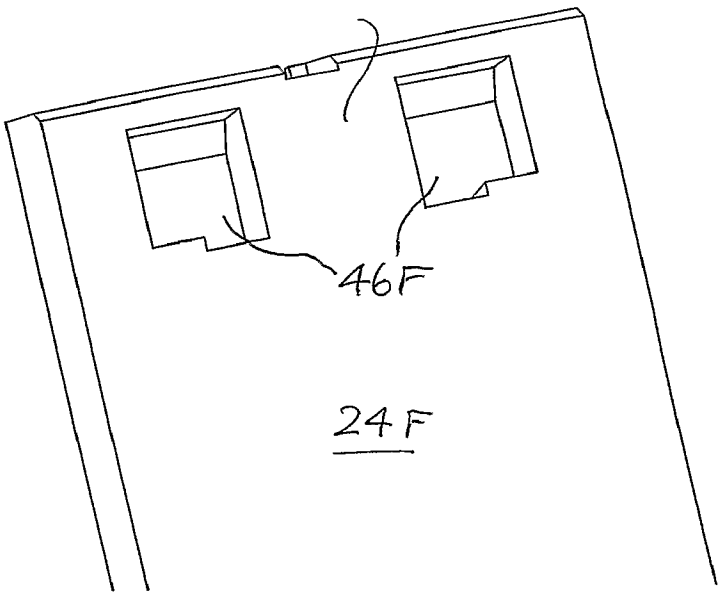
FIG. 11 and FIG. 11A show a front, perspective view of an embodiment of part of a jaw assembly located at a movable jaw stock, in accordance with the present invention. In particular.
Figure 11:
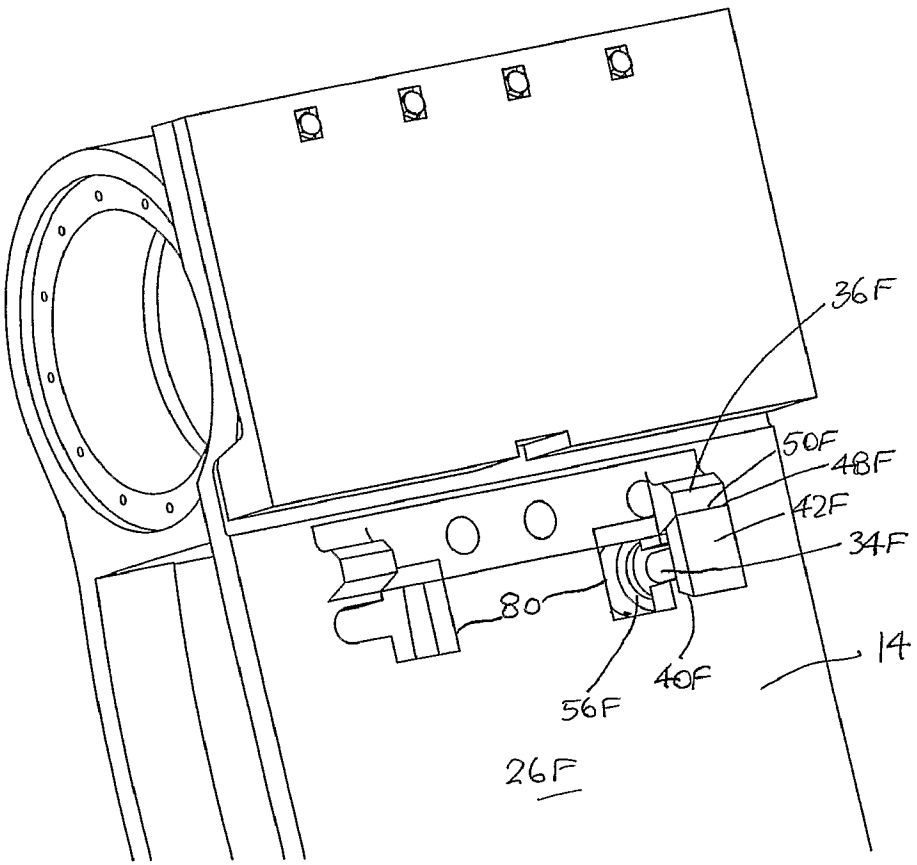
Figures 11B, 11C:
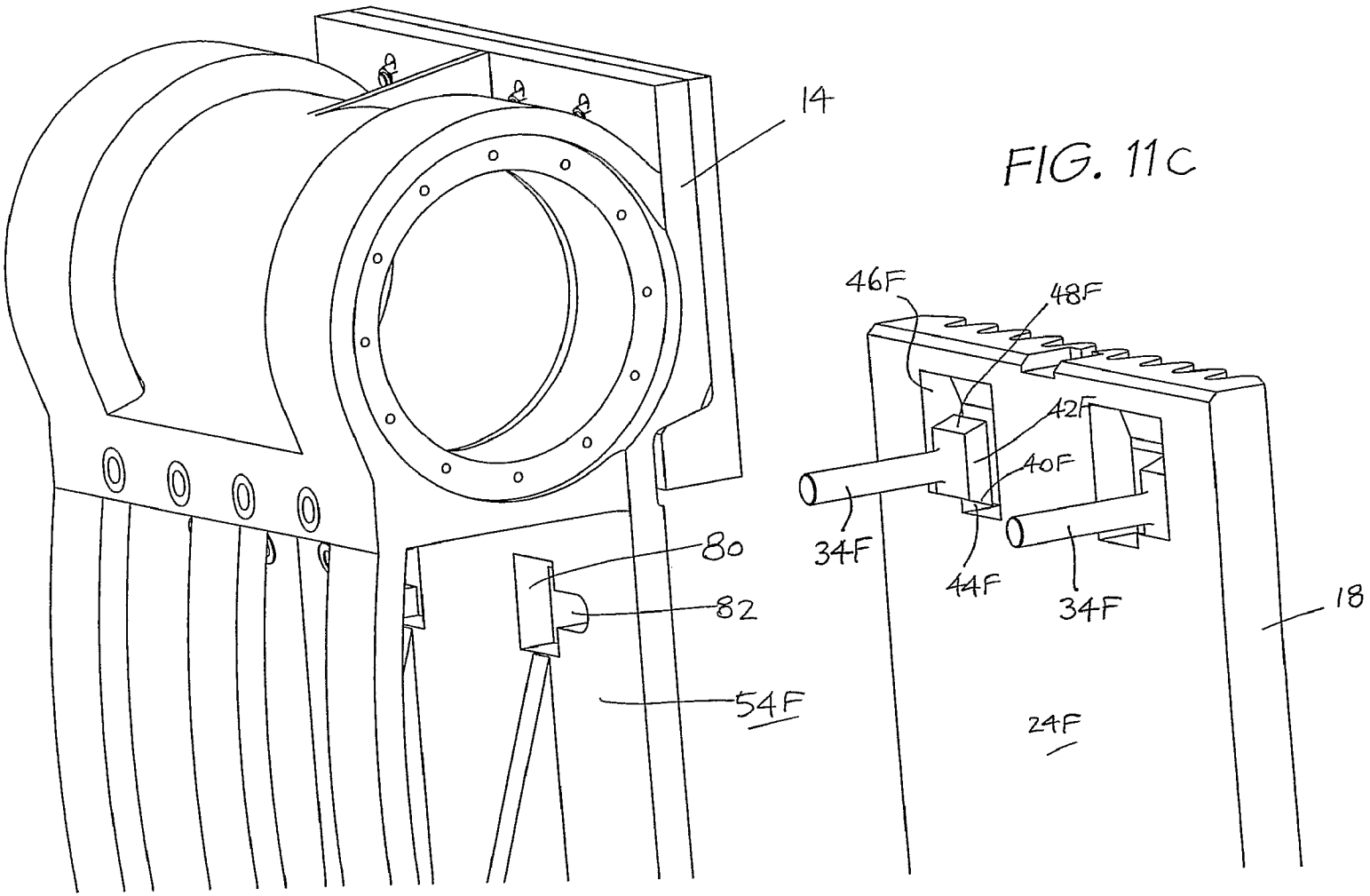
FIG. 11B and FIG. 11C show a rear, perspective view of part of an embodiment of a jaw assembly located at a movable jaw stock, in accordance with the present invention. In particular.

The embodiment shown in FIG. 10 is in all respects similar to that already shown in FIG. 5, except that the uppermost region 70 of the jaw stock 12E is spaced from the lower body 72 of the jaw stock 12E by a narrow stem 74 which allows greater transverse access to the bolt 34E and nut 52E.

Furthermore, in any of the embodiments shown in FIGS. 4 to 10 the respective recesses 62A, 62B, 62C, 62D and 62E can also be fully or partially enclosed at the side of the jaw crusher by means of a detachable plate having a similar function to the detachable plate 90 shown in FIGS. 1B, 1C and 1D located at a jaw stock. The plate used in these embodiments need not be of the same shape as that shown in FIGS. 1B, 1C and 1D, but arranged to be of a suitable configuration for the particular circumstance.

The embodiment shown in FIGS. 11, 11A, 11B and 11C relates to the positioning of a wear plate 18 at a movable jaw stock 14. In this arrangement two fastening devices in the form of an elongate, rectangular-headed bolt 34F are shown extending between the jaw stock 14 and the wear plate 18. Each bolt 34F can be operated to adopt a clamped configuration in which a clamping force is provided along the axis of the bolt 34F. As depicted, installation of the wear plate 18 involves clamping it so that the lower bevelled side 40F of the or each bolt head 42F bears or presses against a complementary-shaped, side edge 44F of a respective recess 46F that is located in the rear face 24F of the wear plate 18. The upper bevelled side 48F of the bolt head 42F simultaneously presses against a complementary-shaped side edge 50F of a protrusion 36F that is mounted to the front face 26F of the jaw stock 14. In use each bolt 34F can be retracted away from the wear plate 18 in an axial direction by rotation of a nut 52F (not visible) which is located at the distal end of the bolt 34F away from the rectangular head 42F. This results in a biasing and clamping of the wear plate 18 against the jaw stock 14. In this embodiment, a hydraulic washer 56F is positioned between the nut 52F and the outer back wall 54F of the jaw stock 14. In this arrangement, when assembled the wear plate rear face 24F is in a close-facing relationship with the front face 26F of the jaw stock 14 and the wear plate 18 is sufficiently strongly mounted to the jaw stock 14 for operation of the jaw crusher 10.

An operator can reach a hand or a tool into the rear of the jaw stock 14 and loosen the nut 52F and washer 56F to permit movement of the bolt 34F in an axial direction. During assembly, the rectangular head 42F of each bolt 34F is first positioned by being received through a respective rectangular hole 80 in the jaw stock 14, the hole 80 having a slightly larger cross-section than the head 42F of the bolt 34F. Then the shaft portion of the bolt 34F is moved by sliding in a direction transverse to the fastening axis of the bolt 34F, into a narrower slot 82 which depends from the rectangular hole 80. In this position, the bolt 34F may then be tightened into the clamped configuration (or loosened therefrom). The two recesses 46F are shown discretely spaced apart and positioned some distance from the side edges of the wear plate 18 so that the each bolt 34F remains in the general vicinity of a respective recess 46F whilst still being moveable to allow the wear plate 18 to be released from the jaw stock 14.

In other embodiments there can be just one (or any number of) bolt(s) and complementary recess(es) in the wear plate 18. In further embodiments, other shapes of bolt and bolt head can be used, as well as other means of tensioning the bolt.

As shown in the FIGS. 11, 11A, 11B and 11C, the bolt 34F itself is concealed from the interior 28 of the jaw crusher 10 when located in the wear component recess 46F, so as to minimise abrasive wear. This reduces the incidence of wearing of the clamping fasteners 34F by materials that flow into the crusher during use.

In other embodiments, the wear plate can be held in position by any number of interfitting projections and recesses located between the jaw stock and the wear plate. The projections can be any type of ridge, flange or discrete projecting tab or pin, for example, formed or fitted so that when the wear plate is seated at the jaw stock they assist with the fastening of that wear plate. For example, such projections can be integrally formed to extend from a rear face of a wear plate which in use is itself arranged to be located in a close-facing arrangement with a front inner face of a jaw stock. In such an arrangement the projections are received in complementary-shaped recesses arranged in the jaw stock.

In further embodiments, the fasteners used can be other types of elongate pins or wedges for receipt into a mating cavity or ridge. In some embodiments, removable fasteners can be positioned in a tight frictional or interference fit within the receptive cavity rather than using retention nuts or washers.

In other embodiments, each wear plate need not be in the form of a single wear plate, but can be made up of a number of planar pieces or segments of impact and/or wear resistant material which are separately fastened into place on the jaw stock and which generally form one continuous or planar surface. In still other embodiments, depending on the jaw crusher shape and configuration, the working face of the wear plate can be of a shape other than the ribbed planar version shown in the Figures.

In other embodiments, the jaw stock itself can be comprised of two separate pieces, for example a main portion in the form of a casting which is fitted with one or both of a "backing plate" and an "intermediate plate" disposed in use to be located between the base member and the wear component. The function and purpose of the backing plate (or protection plate, heel plate or sole plate) and the intermediate plate have been previously described in this specification.

The performance and maintenance requirements of jaw crushers, as well as operating costs are affected by how long it can take for parts to be changed (i.e. machine downtime). For the embodiments described, the inventor has shown that reduced maintenance interval times can be combined with safer and easier changing of jaw crusher parts by using removable fastening devices which are accessible from a direction transverse to their fastening axis. Overall, such improvements can lead to lower materials processing costs.

The materials of construction of the wear plate and the fasteners described can be any suitable materials which wear appropriately, and that can be shaped, formed and fitted in the manner so described, such as the appropriate metal, metal alloys or even ceramics, and so on.

It is to be understood that, if any prior art information is referred to herein, such reference does not constitute an admission that the information forms a part of the common general knowledge in the art, in Australia or any other country.

Whilst the invention has been described with reference to preferred embodiments it should be appreciated that the invention can be embodied in many other forms.

The invention claimed is:

1. A jaw assembly for a jaw crusher, the assembly comprising:

a jaw stock having a front face and two sides depending from the front face;

a wear component, and a fastening device extending between the jaw stock and the wear component, the device being operative to adopt a clamped configuration where the device provides a clamping force along a fastening axis to clamp the wear component against the front face of the jaw stock, and a released configuration where the fastening device does not prevent the wear component from being separated from the jaw stock, wherein the jaw assembly incorporates a cavity that extends transversely through the or each side of the jaw stock from said fastening device to allow access to said fastening device, wherein the fastening device is accessible through the cavity from a direction transverse to the fastening axis to enable the device to be changed from its clamped configuration to its released configuration, wherein the fastening device when in the released configuration is removable via the cavity from the direction transverse to the fastening axis.

2. A jaw assembly as claimed in claim 1, wherein the fastening device is accessible from a direction transverse to the fastening axis to enable the device to be changed from its released configuration to its clamped configuration.

3. A jaw assembly as claimed in claim 2 in which the cavity is adapted to be fully or partially enclosed by a detachable member.

4. A jaw assembly as claimed in claim 1, wherein the wear component is a wear plate arranged with a rear face and a working face spaced apart by two side edges, the rear face arranged to be located in a close facing arrangement with the front face of the jaw stock when in the clamped configuration.

5. A jaw assembly as claimed in claim 1, wherein the fastening device comprises a bolt with a head that is arranged to bear against a surface of the wear component when in the clamped configuration.

6. A jaw assembly as claimed in claim 5, wherein the fastening device also comprises a nut arranged to be located at an end region of the bolt which is opposite the head, the nut being arranged to bear against a part of the cavity of the jaw stock when in the clamped configuration.

7. A jaw assembly as claimed in claim 5, wherein the head of the bolt is received in a recess which is located at the rear face of the wear component.

8. A jaw assembly as claimed in claim 7, wherein the said wear component recess also extends from the bolt to allow the bolt to be moved in a direction transverse to the fastening axis of the bolt.

9. A jaw assembly as claimed in claim 8, wherein the bolt when in the released configuration is removable via said wear component recess.

10. A jaw assembly as claimed in claim 7, wherein said wear component recess is concealed from, view at the working face so that when the bolt is received in the wear component recess it is not visible from an interior of the jaw crusher.

11. A jaw assembly as claimed in claim 5, wherein the head of the bolt is arranged to bear against an uppermost in use edge of the wear component.

12. A jaw assembly as claimed in claim 11, wherein the said uppermost in use edge of the wear component is arranged to allow the bolt to be moved in a direction transverse to the fastening axis of the bolt.

13. A jaw assembly as claimed in claim 1, wherein the fastening device comprises a bolt with a head and an elongate bar, wherein the head of the bolt is arranged to bear against the elongate bar which is itself positioned to bear against an uppermost in use edge of the wear component when in the clamped configuration.

14. A jaw assembly as claimed in claim 13, wherein the head of the bolt is arranged to be positioned in a recess located in the elongate bar.

15. A jaw assembly as claimed in claim 14, wherein said recess also extends from the bolt to allow the bolt to be moved in a direction transverse to the fastening axis of the bolt.

16. A jaw assembly as claimed in claim 14, wherein the bolt is arranged to be positioned at the elongate bar by threading engagement.

17. A jaw assembly as claimed in claim 7, wherein the said wear component recess defines a slot into which the bolt can be moved in a direction transverse to the fastening axis of the bolt and in which the bolt is located in the clamped configuration.

18. A jaw assembly as claimed in claim 1, wherein the wear component is made of a wear resistant material.

19. A jaw assembly as claimed in claim 1, wherein the fastening device and the wear component are defined by an arrangement of interfitting projections and recesses.

20. A jaw assembly as claimed in claim 1, wherein the fastening axis is arranged substantially orthogonally to the jaw stock and to the wear component.

21. A jaw assembly as claimed in claim 1, wherein the jaw stock comprises two or more pieces.

22. A jaw assembly as claimed in claim 20 wherein the jaw stock comprises a base member and one or both of a backing plate and an intermediate plate fitted thereto disposed in use to be located between the base member and the wear component.

23. A jaw crusher including the jaw assembly as defined in claim 1.

* * * * *

UNITED STATES PATENT AND TRADEMARK OFFICE

CERTIFICATE OF CORRECTION

PATENT NO. : 8,256,698 B2
APPLICATION NO. : 12/445382
DATED : September 4, 2012
INVENTOR(S) : Brett Gregory Holmes It is certified that error appears in the above-identified patent and that said Letters Patent is hereby corrected as shown below:

On Title Page:
Item (75) Inventor, Please correct "Brett Gregory Holmes, Boya (AU)"
to read -- Brett Gregory Holmes, Boya, Western Australia (AU) --

Item (73) Assignee, Please correct "Crushing & Mining Equipment Pty., Ltd., Naval Base, Western (AU)"
to read -- Crushing & Mining Equipment Pty., Ltd., Naval Base, Western Australia (AU) --

In the Claims:
Column 13, Claim 10, Line 9: Please correct "concealed from, view at the"
to read -- concealed from view at the --

Signed and Sealed this
Eleventh Day of June, 2013

Teresa Stanek Rea
*Acting Director of the United States Patent and Trademark Office*